US006454147B1

(12) United States Patent
Marks

(10) Patent No.: US 6,454,147 B1
(45) Date of Patent: Sep. 24, 2002

(54) PERSONAL TOOL CARRYING DEVICE

(75) Inventor: Joel Marks, Sherman Oaks, CA (US)

(73) Assignee: WorkTools, Inc., Chatsworth, CA (US)

( * ) Notice: Subject to any disclaimer, the term of this patent is extended or adjusted under 35 U.S.C. 154(b) by 0 days.

(21) Appl. No.: 09/569,883

(22) Filed: May 12, 2000

(51) Int. Cl.[7] ..... A45F 5/00

(52) U.S. Cl. ..... 224/268; 224/197; 224/272; 224/904

(58) Field of Search ..... 224/197, 198, 224/268, 271, 272, 666, 904; 248/220.31, 220.41, 220.43, 222.11, 308

(56) References Cited

U.S. PATENT DOCUMENTS 2,526,768 A * 10/1950 Pendergrass
2,856,111 A * 10/1958 Wolfe et al.
3,082,990 A * 3/1963 Nelson
3,289,985 A * 12/1966 Sheiman
3,434,638 A * 3/1969 Beynon
3,469,710 A * 9/1969 Vosbikian
4,883,290 A 11/1989 Landa
4,962,873 A 10/1990 Schattel
5,743,451 A 4/1998 Kahn
5,934,530 A * 8/1999 Antczak et al.
6,062,449 A * 5/2000 Kahn

* cited by examiner

*Primary Examiner*—Gregory M. Vidovich

(57) ABSTRACT

A personal tool carrying device provides improvements in manufacture and appearance. A hook includes an integrally formed head end that is supported by ribs of a slot of a housing. A friction cap preferably surrounds the head end to hold the hook in a selected rotational position. The head end and friction cap are held in a cavity of the housing by a mounting element such as a belt clip. The housing swivels in relation to the mounting element. The device provides various surfaces for product identifying information.

20 Claims, 4 Drawing Sheets

PERSONAL TOOL CARRYING DEVICE

FIELD OF THE INVENTION

The present invention relates to personal carrying accessories. More precisely the present invention relates to a tool-carrying device.

BACKGROUND OF THE INVENTION

A well-known device to carry tools, supplies and the like is a tool belt. Such belts often have pockets, loops, and in one case, an attached hook to enable a worker to carry items without use of his hands.

U.S. Pat. No. 4,883,290 to Landa shows a ski pole carrier. A spring clip secures the body of the device to a belt or other item worn by a user. A clamp is pivotally attached to the body of the device and holds two ski poles. The poles may be swiveled between vertical and parallel to the user and horizontally.

U.S. Pat. No. 4,962,873 to Schattel comprises a customized tool belt with a permanently attached hook. The device is intended for heavy construction materials such as rebar. The custom belt thus includes shoulder straps to support the load. The hook may be rotated to extend out for use and to lie flat against the belt when not in use. The hook rotation includes detent stops.

U.S. Pat. No. 5,743,451 to Kahn shows a hook that combines the features of '873 and '290. A spring clip allows the hook to be attached and removed from a waist belt as in '290. The hook of '451 further includes a swivel option similar to '290. As in '873 the hook includes an ability to rotate between detents.

None of the prior art suggests a simple smoothly integrated compact design. Further, the prior art do not suggest low cost methods for manufacture using common high-speed production processes. For example the hook of '451 requires secondary operations to create the hole 4*c* in the attaching end of the hook. Another type of operation is suggested using screw threads on the hook at the opposite end to attach a ball end. Inserting pin 5 or screwing on an item requires additional assembly effort.

SUMMARY OF THE INVENTION

It is an object of the invention to provide a lower cost personal tool carrier device, or tool clip. It is a specific object to provide an improved design to a hook-attaching end. It is another object to provide a molded housing that includes substantial and varied surfaces to display product identification information. It is a further object to provide an improved method to apply friction to hold the hook in a rotational position. It is another object to have a simplified assembly process.

The present invention tool clip is a typically waist mounted hook or similar device that attaches to an item of clothing. The tool clip enables a user to carry articles such as power tools while the hands are free to do other things.

In one embodiment a depending hook is rotatable about two distinct axes with respect to a user wearing it. A first horizontal axis allows the hook to swivel and the hook to remain oriented downward as a user bends over or moves around. In a second axis substantially perpendicular to the first axis the hook rotates toward and away from the user to adjust and stow the hook.

The present invention comprises a molded housing, preferably of plastic material such as polycarbonate although die cast or other metal would be suitable. A hook includes a "U" shaped metal bar with an enlarged head end. A flexible friction cap surrounds the head including an interference fit to resist the head from rotating within the cap. The cap and head together are installed into a cavity of the housing. A belt clip is secured to the backside of the housing to securely confine the hook head end and cap in the cavity of the housing. A ball end may be attached to the distal end of the hook.

The hook can be manufactured using cold heading methods that are common for making bolts. According to this process a wire is drawn to a desired diameter after which a die forcibly moves the material at one end to form a head. The head is commonly a hexagonal shape, although square, round, recessed, 12 point and other head shapes are known and may be used.

The head end is preferably held within the housing so that it has some resistance to turning. Any resilient material may provide the function of the friction cap although molded plastic may be preferred. Further the function of the friction cap may be provided by elements of just the housing or a combination the housing and the belt clip.

DETAILED DESCRIPTION OF THE INVENTION

Figure 2:
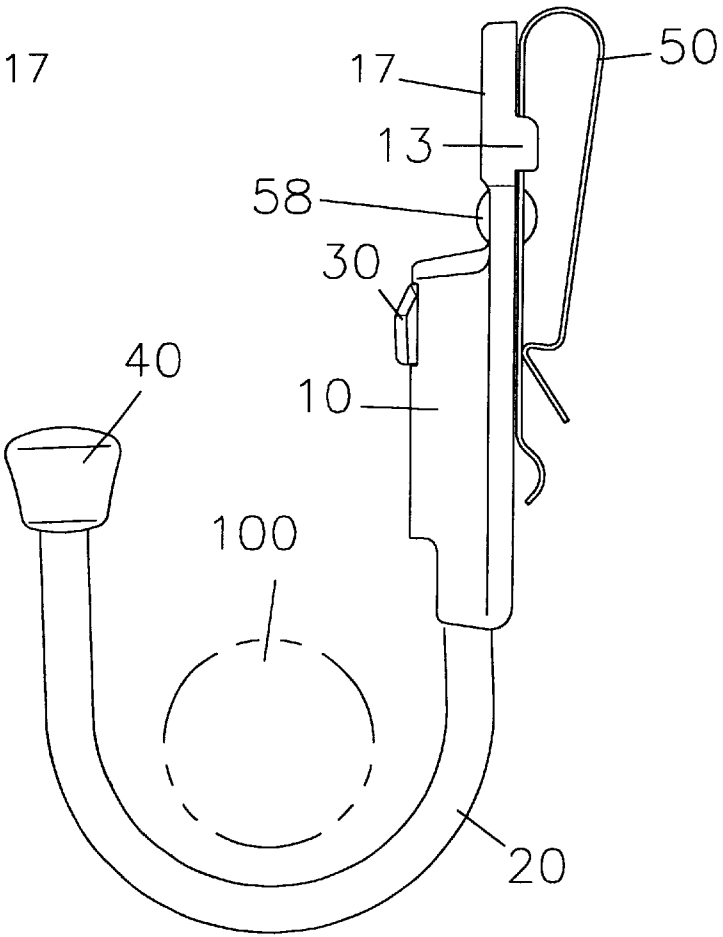
FIG. 2 is a side elevation of the tool clip of FIG. 1 with the hook extended.
Figure 1:
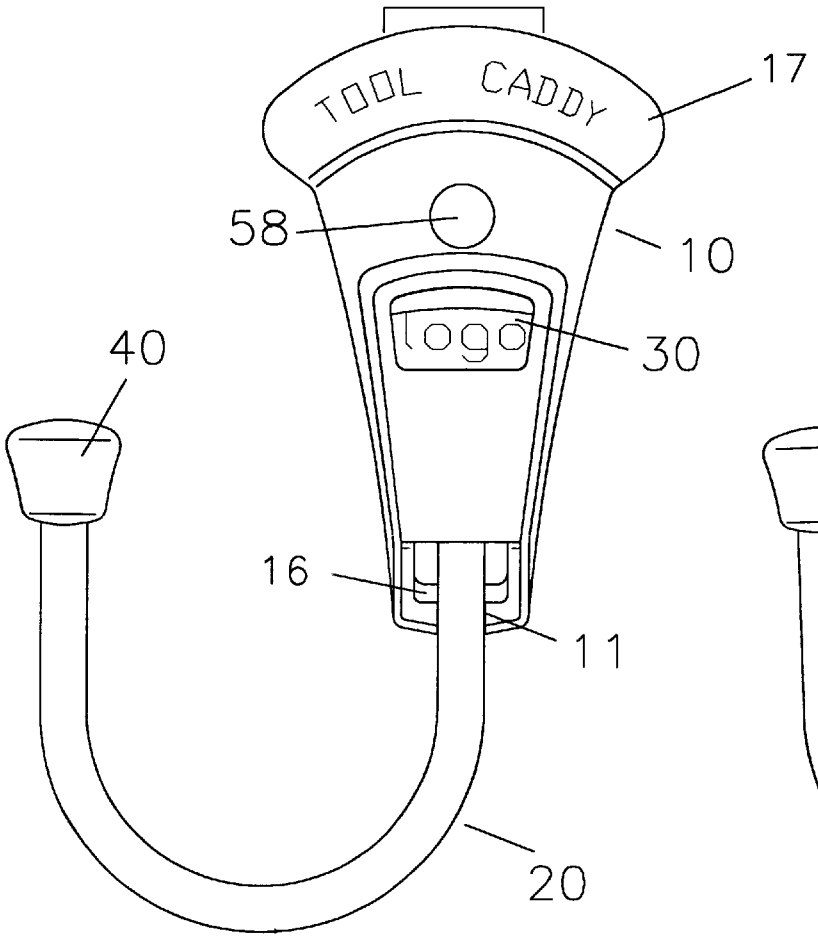
FIG. 1 is a front elevation of a tool clip with a hook in the stowed position.

FIGS. 1 and 2 show the present invention in a preferred embodiment. Belt clip 50 is a mounting element that holds the tool clip of the invention to a user's belt, waistband or other clothing. Belt clip 50 is normally removable from a user's belt, although it could be permanently or semi-permanently attached to a belt or other clothing article. For example, if holes were provided in the belt clip a string, band or wire could be threaded through the holes to hold the tool clip more securely. In FIG. 1 hook 20 is rotated to a stowed position where it lays closely against a user. In FIG. 2 hook 20 is rotated outward to enable convenient storage of an article 100 that is to be carried. Article 100 is shown as a generic sectional view. It may be a power tool such as a drill, building materials, other tools or any item that can be suspended by a hook. Alternately, other forms may be used in place of hook 20 such as a fork, loop, pouch, shelf, or other configuration to hold items that are not suited to be held by a hook.

Figure 9D:
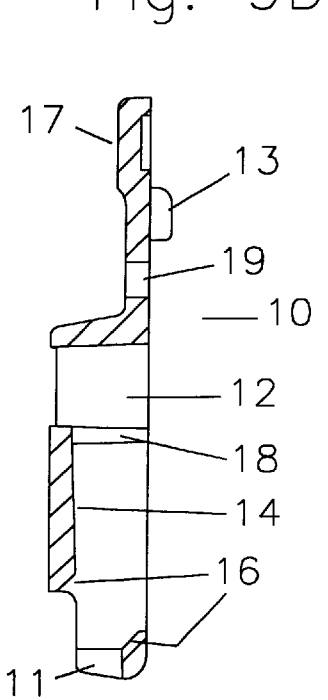
FIG. 9D is a partially sectional view of the housing in the direction of the view of FIG. 9C.
Figure 9G:
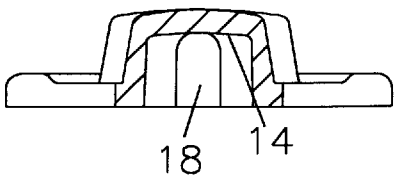
FIG. 9G is a partially sectional view of the housing in the direction of the view of FIG. 9E.
Figure 9C:
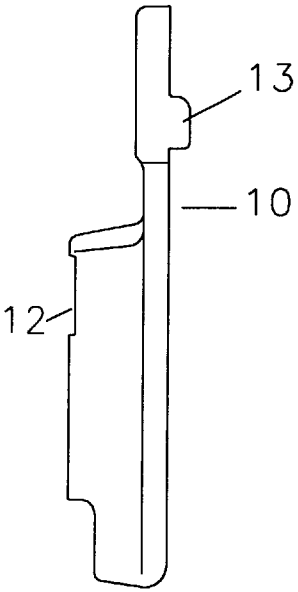
FIG. 9C is a side elevation of the housing.
Figure 9B:
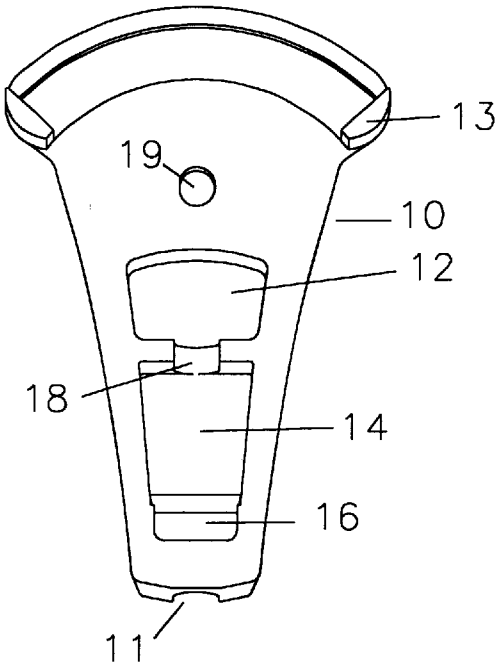
FIG. 9B is a back and slightly bottom view of the housing.
Figure 9F:
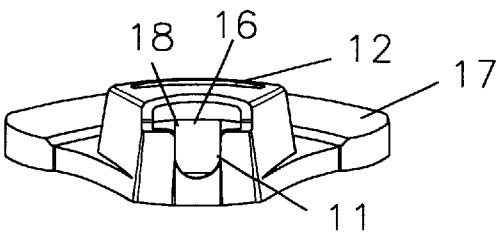
FIG. 9F is a bottom and slightly front view of the housing.

Housing 10 may swivel against belt clip 50 about hole 19 (FIG. 9B), where belt clip 50 is pivotally attached to housing 10 by rivet 58 (FIGS. 1, 6, 7) or a screw or equivalent method. Such a method may include an integral post of housing 10 that is swaged or melted over hole 52 (FIG. 6A) to retain belt clip 50 to housing 10. Rivet 58 defines a horizontal swivel axis.

Figure 8:
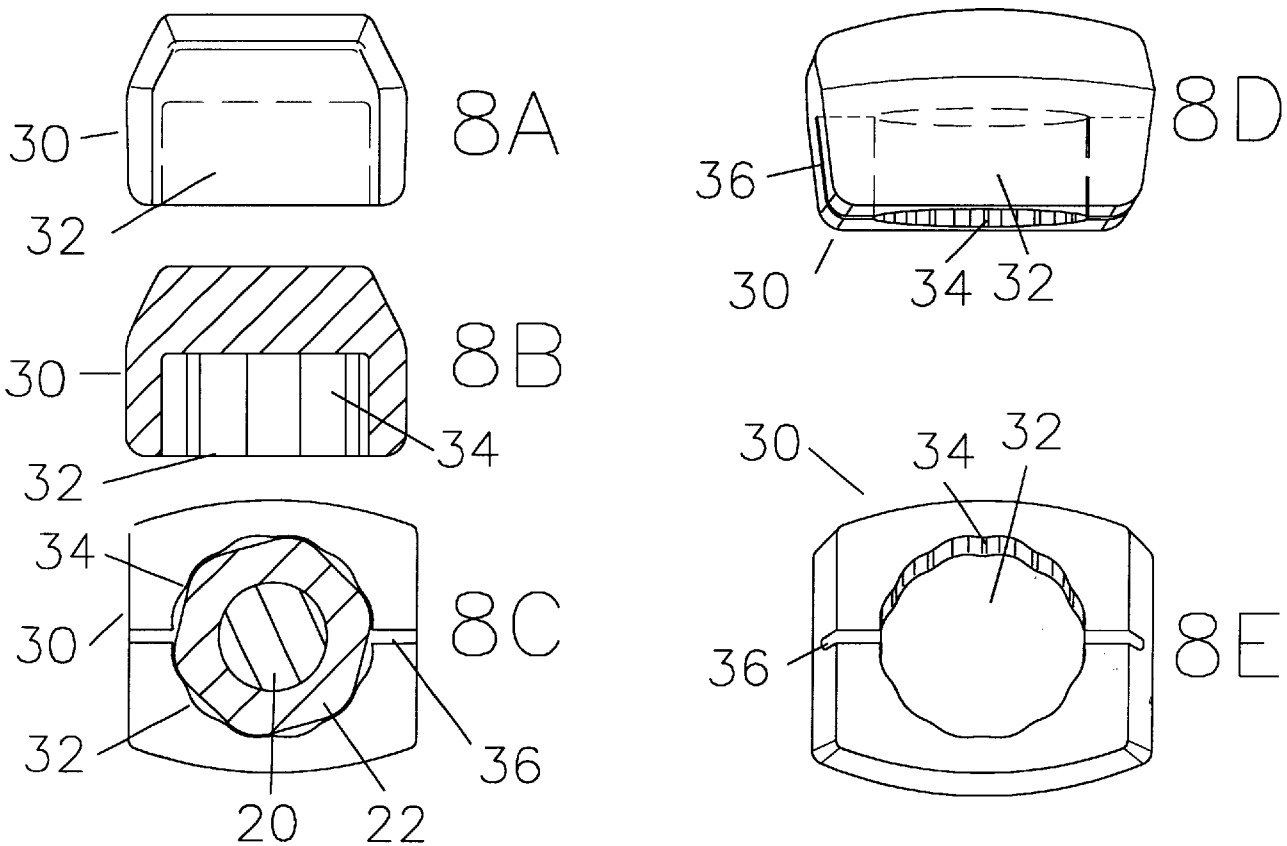
FIG. 8A is an end view of a friction cap.
FIG. 8B is a partial sectional view of the friction cap in the direction of the view of FIG. 8A.
FIG. 8C is a bottom view of the friction cap including a sectional bolt shank and bolt head within the cap.
FIG. 8D is a primarily side slightly bottom perspective view of the friction cap.
FIG. 8E is primarily bottom perspective view of the friction cap.
Figure 9A:
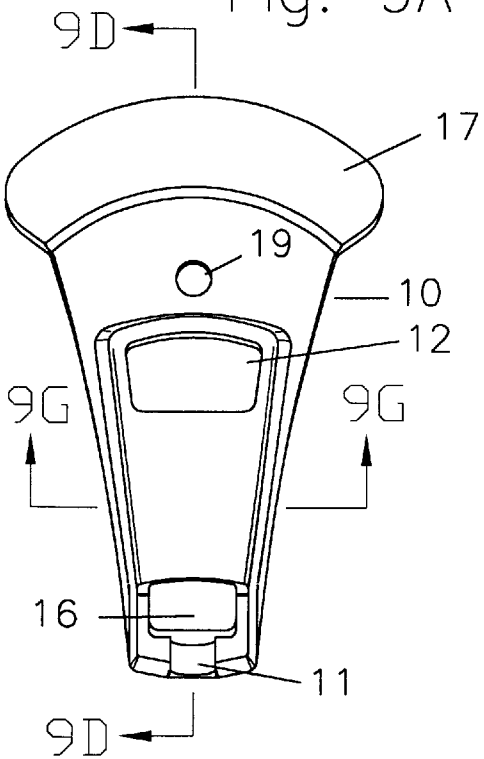
FIG. 9A is a front and slightly bottom view of a tool clip housing.
Figure 9E:
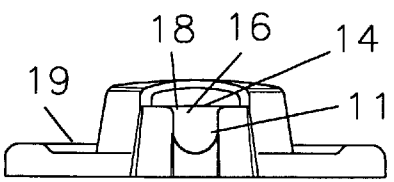
FIG. 9E is a bottom elevation of the housing.

Housing 10 provides a structure to contain, guide and support the components of the tool clip. The components are preferably well contained within housing 10 for a pleasing appearance, however housing 10 could be minimally designed to expose the components if it is desired for example to reduce material usage. Hook 20 extends down from slot 11 (FIGS. 1, 9A) of housing 10. Friction cap 30 (FIGS. 1, 2, 8) may include a logo embossed or printed on an exposed surface as in FIG. 1. This corresponds to the side surface of FIG. 8D. Optionally raised area 17 of housing 10 may also include product information, shown in FIG. 1 as the name "Tool Caddy". Area 17 is relatively wide, FIG. 1, to provide support against a user to increase stability as the weight of article 100 swings about. The position of stops 13 relative to pivot 19 (FIG. 9B) establish limits for the possible motion of housing 10 to swive about pivot 19 to varying angles relative to a user. l Stops 13 are not required and may be omitted, but they will help to reduce uncontrolled swinging of the tool clip as a user moves around.

Figure 3:
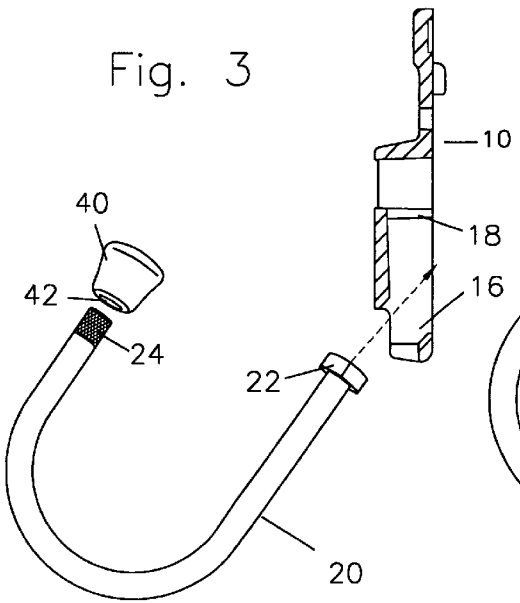

The design of hook 20 is best seen in FIG. 3. In the illustrated embodiment hook 20 comprises a long "U" shaped bolt including integrally formed hexagonal head end 22. At the distal end of hook 20 knurl 24 helps retain press-fitted end cap 40 to hook 20. End cap 40 includes recess 42 to receive the distal end of hook 20. Alternately end cap 40 can be overmolded directly onto the end of hook 20. End cap 40 provides a finished appearance and protective cover for the end of hook 20. A rounded end may instead be directly coined into the distal end of hook 20. Hook 20 is preferably of a soft metal such as aluminum to allow it to be bend to slightly different shapes. Alternately hook 20 may be a steel wire covered by an elastomer or plastic material, or all plastic. In this case a soft end for hook 20 can be molded as part of the elastomeric cover.

Figure 5:
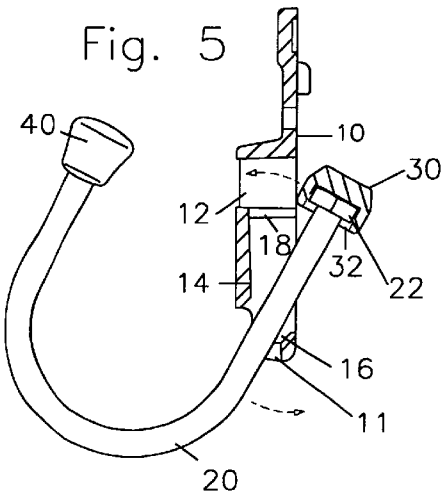
FIGS. 3 to 7 show an assembly method for the components of the tool clip.

Head end 22 of hook 20 is enlarged to enable hook 20 to be retained within housing 10. Slot 18 (FIG. 6, 9B) is formed by ribs of housing 10. When hook 20 is pulled downward by the weight of article 100, the underside of head end 22 is supported by slot 18. In FIG. 6 a gap is seen between the ribs defining slot 18 and the underside of head end 22. This gap would be closed as hook 20 moves downward from the weight of article 100. However the gap illustrates that hook 20 need not be precisely vertically positioned within housing 10. Slot 18 may also position hook 20 at the head end laterally, in and out of the page in FIGS. 3–7, within housing 10. The top surface of head end 22 presses within friction cap 30 or another surface to confine hook 20 from above. Optionally head end 22 may be similar in diameter to the main shank of hook 20, where the head is defined as the portion of the hook above a circumferencial groove just under the head. The groove could be roll formed into hook 20 where slot 18 fits within the groove and positions hook 20 vertically. This hook holding concept is equivalent to the illustrated enlarged head end 22.

Head end 22 is positioned within housing 10, other than in the downward direction, primarily by being fitted in recess 32 of friction cap 30 (FIG. 8C). Friction cap 30 is preferably of a resilient material to provide resistance against rotation of head end 22, and thus hook 20, within recess 32 of friction cap 30. Cap materials may include nylon, acetal, elastomers, or resilient fingers or similar features of a metal spring device. In the case of a metal friction cap 30, the detailed appearance of cap 30 would likely differ. For example a cup with multiple fingers forming walls surrounding head end 22 could be designed. If desired, cap 30 may fit head end 22 loosely so that hook 20 rotates freely toward and away from a user. The rotation axis defined by friction cap 30 and slots 11 and 18 is a hook pivoting axis substantially perpendicular to the horizontal swivel axis described above.

Friction cap 30 is retained in cavity 12 of housing 10. Therefore hook 20 is frictionally retained within housing 10 against rotation. Enlarged head end 22 provides two functions for hook 20; vertical retention as described above, and a large outer diameter surface to provide an effective braking surface that is in contact with the interior of friction cap 30. It is not required that friction cap 12 be fitted within a cavity of the housing. Rather a version of friction cap 30 may be attached to any surface of housing 10 by, for example, rivet 58. For example friction cap 30 may comprise a clamshell design where it is closed around head end 22 and then attached to housing 10. A feature of the invention is that some type of friction element works to restrain the hook from rotating while the hook is prevented from pulling out of the housing by confining the enlarged head.

Another way to frictionally engage hook 20 rotationally within housing 10 is to resiliently press the outer diameter of hook 20 in the region of interior wall 14, or other than at head end 22. Wall 14, multiple ribs or a separate coaxial friction element may press or surround hook 20 below head end 22, or above the head if the hook shank extends that way. A clamshell or two-piece design for this separate friction element would ease assembly. These methods, combined with the head defining groove described above, may provide a more compact device since the head end could be of smaller diameter.

However by pressing the enlarged diameter of head end 22, the illustrated friction cap 30 is more effective for preventing rotation than if it pressed only the narrower main body of hook 20. The friction cap may press head end 22 from above, below or both, rather than from the outer diameter of head end 22. In this case a clamshell or partial clamshell design would allow the friction cap to be installed laterally onto head end 22, or the head end to be moved into the friction cap, rather than the cap installed from above the head end as in the illustrated embodiment. Ribs of this cap could contact top and bottom faces of head end 22.

Recess 32 preferably includes undulating wall 34 which provide detents to engage the non-circular head end 22 and hold hook 20 in various positions If a detent action is not desired one or both of head end 22 and wall 34 may be circular. As long as there is an interference fit between head end 22 within recess 32, hook 20 will be frictionally engaged by friction cap 30. In the preferred embodiment head end is hexagonal at least in part because it is a well-known shape for manufacture. It can be seen in FIG. 8C that the corners of head end 22 are preferably well rounded to prevent wear upon wall 34 of friction cap 30. Friction cap 30 may include at least one notch or channel 36 to enhance the expandability of recess 32 as head end 22 rotates between detents within recess 32.

If housing 10 is of a suitable material and proper molding techniques are used the function of friction cap 30 may be included as an element of housing 10, for example as the walls of cavity 12. Nylon is both a sturdy structural material and a resilient material. Nylon could thus form a single piece housing and friction cap. Head end 22 can be surrounded on three sides by the walls of cavity 12 while optionally a surface of or finger formed in belt clip 50 or other object could press from the back against head end 22. Alternately the resiliency of belt clip 50 could alone provide pressure and thus friction against head end 22 if belt clip 50 were positioned closely enough to head end 22. However if hook 20 is made of aluminum and belt clip 50 is spring steel, belt clip 50 pressing only from one side of head end 22 may cause excessive wear on head end 22.

As a design choice a portion of friction cap 30 or another element of the tool clip device may directly contact the underside of head end 22. But head end 22 is at least indirectly supported from falling downward by a member of housing 10.

Figure 4:
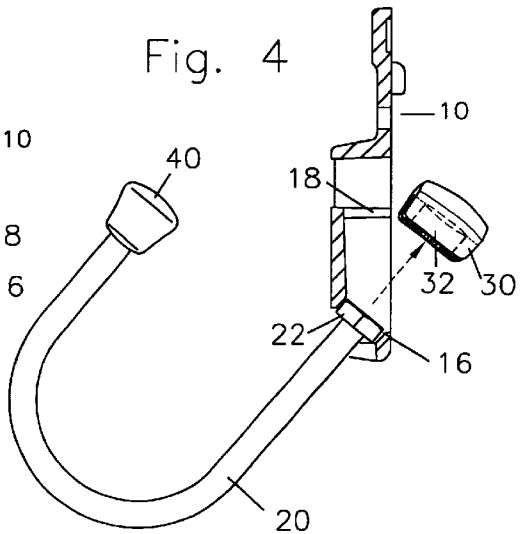

The present invention includes a method for assembly of a tool clip device. Various stages of the assembly method are shown in FIGS. 3–7. Relevant features of housing 10 are also shown in the views of FIG. 9. In FIG. 3 head end 22 of hook 20 is being installed through opening 16 in housing 10. At some point in the assembly process end cap 40 is pressed onto the distal end of hook 20. Recess 42 is forced over knurl 24. End cap 40 may be attached or formed before, during, or after the other assembly steps are completed. In FIG. 4 hook 20 has moved up so that head end 22 is within opening 16, while friction cap 30 is prepared behind housing 10 to receive head end 22. In FIG. 5 hook 20 has moved further up so that head end 22 extends rearward of housing 10. Friction cap 30 is placed around head end 22. The assembly of hook 20 with friction cap 30 is moved so that friction cap 30 is aligned with cavity 12. If friction cap 30 is omitted as described above, head end 22 alone enters cavity 12. Hook 20 is rotated counterclockwise in FIG. 5 about opening 16 so that friction cap 30 enters cavity 12 and head end 22 moves atop slot 18 as in FIG. 6. Hook 20 moves into slot 18. See also FIG. 9B. Interior wall 14 of housing 10 forms a barrier to confine hook 20 at a hook front side. Slot 11 confines a lower rear side of hook 20. Housing 10 thus holds hook 20 securely when a weight from article 100 is applied since hook 20 cannot rotate further counterclockwise in FIG. 6. Slot 11 and optionally 18 together position hook 20 side to side as apparent in FIG. 9B. Friction cap 30 may do such positioning instead of slot 18. Therefore in FIG. 6 hook 20 is held within housing 10 except that hook 20 can rotate clockwise while friction cap 30 can move rearward out of housing 10 in a reverse of the assembly process.

Figure 6A:
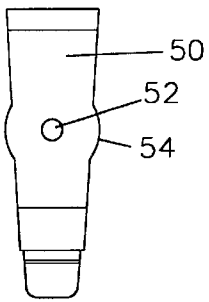
Figure 6:
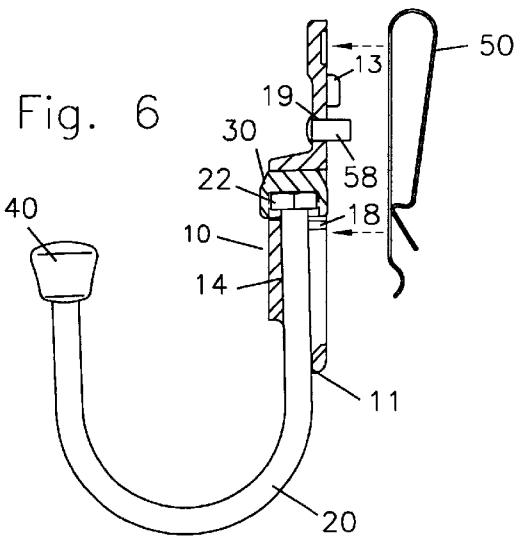

In the final assembly step belt clip 50, shown in rotated 90° in FIG. 6A, is attached to housing 10. Belt clip 50 is moved into position whereby hole 19 of housing 10 is aligned with hole 52 of belt clip 50. Rivet or similar fastener 58 is placed through the respective holes and secured in place. If a conventional rivet is used, hole 52 may comprise two aligned holes through both downward extending fingers of belt clip 50. Then rivet 58 can be pressed from both ends easily since an anvil tool may pass through the backside hole into the cavity formed by the fingers of belt clip 50. A one sided rivet such as a Pop rivet would not require a backside hole in belt clip 50.

When belt clip 50 is fastened to housing 10, friction cap 30, and thus head end 22, are confined from the rear by belt clip 50. As explained earlier, stops 13 limit the possible rotation of housing 10 about rivet 58 against belt clip 50. An additional reason for such stops is to ensure that belt clip 50 never moves entirely out from behind friction cap 30. If belt clip 50 were not wide enough, and it were rotated to a horizontal position, friction cap 30 could become fully exposed and be able to fall out of place. If clip 50 is wide enough stops 13 may be omitted.

If belt clip 50 is of constant thickness, and were also of constant width, bending stresses as it is spread apart in use would be greatest at the top area since the fingers of the clip are equivalent to cantilevered beams. In the illustrated embodiment belt clip 50 includes a tapered shape in FIG. 6A. Then the spring energy of bending is stored more evenly along the length of the clip since the area of most bending stress is also the stiffest. Protrusions 54 provides additional material where material is lost to hole 52.

In an alternate embodiment housing 10 may be pivotally attached permanently to a mounting element such as a tool belt or other clothing item. For example if housing 10 is fastened at hole 19, or equivalent location, to a stiff leather belt the belt would act to confine friction cap 30 and/or head end 22 within cavity 12. Or if as discussed earlier friction cap 30 is held to housing 10 by other means such as by rivet 58, and not necessarily within a cavity, then the leather belt would need to only pivotally support housing 10 but not confine friction cap 30 in a cavity. Alternately belt clip 50 may be permanently riveted to the tool belt.

Figure 7:
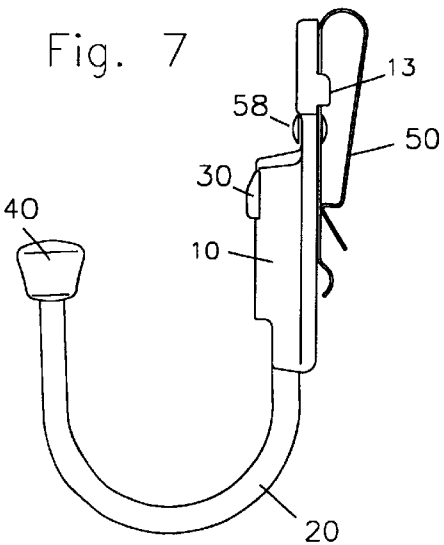

FIG. 7 shows the assembled tool clip similar to the view of FIG. 1. The tool clip according to the invention is simple to produce. The housing is a small molded part with no undercuts or other complex features. The hook is substantially a conventional "U" bolt including a largely conventional head. The friction cap is a single piece, or is included as part of the housing. During the operation to fasten the belt clip the components of the assembly are also secured in place. No cotter pins, nuts, plastic bonding or other secondary operations are required. An innovation of the invention is the use of integrally formed head end 22 while also providing a way to install the enlarged head into housing 10.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims following.

I claim:

1. A personal carrying device including a mounting element that provides for attaching the device to a user, a normally depending hook, the hook rotatable about a first axis, the hook further rotatable about a second axis substantially perpendicular to the first axis, wherein:

the carrying device includes a housing pivotally attached to the mounting element to allow swivel motion of the housing about the first axis;

the hook is held by the housing wherein the hook is pivotable upon the housing about the second axis;

the housing includes a slot formed by ribs of the housing, the slot extends from an open end of the slot into the housing in a direction perpendicular to the second axis, a shank of the hook passes through the slot along the second axis whereby the ribs of the slot substantially surround the shank, the hook includes a formed head end, the head end having an underside supported by the ribs of the slot of the housing.

2. The carrying device of claim 1 wherein the mounting element confines the head end within the housing such that the shank of the hook cannot move out of the slot in a direction perpendicular to the second axis.

3. The carrying device of claim 1 wherein the mounting element is a belt clip.

4. The carrying device of claim 3 wherein the belt clip is removable from the user.

5. The carrying device of claim 1 wherein the slot of the housing positions the hook laterally within the housing.

6. The carrying device of claim 1 wherein a component of the carrying device contacts the hook to provide resistance against pivoting of the hook about the second axis.

7. The carrying device of claim 6 wherein the component is a friction cap which surrounds an outer diameter surface of the head end, and the head end is enlarged in diameter in relation to a main shank of the hook.

8. The carrying device of claim 7 wherein the friction cap is confined within a cavity of the housing.

9. The carrying device of claim 8 wherein the friction cap is further confined by the mounting element.

10. The carrying device of claim 7 wherein a recess of the friction cap includes detents, and the outer diameter of the head end comprises a non-circular shape to engage the detents such that the hook pivots about the second axis between predetermined stop positions.

11. The carrying device of claim 1 wherein stops of the housing limit rotation of the housing about the first axis.

12. The carrying device of claim 1 wherein the head end is integrally formed by cold heading wherein material of the hook is forcibly moved to create an enlarged diameter portion of the hook.

13. The carrying device of claim 1 wherein the head end is a portion of the hook above a circumferencial groove just under the head.

14. A personal carrying device including a mounting element that provides for attaching the device to a user, a normally depending hook, the hook rotatable about a first axis, the hook further rotatable about a second axis substantially perpendicular to the first axis, wherein:

the hook includes a formed, enlarged head end;

the hook is supported by the carrying device from an underside of the head end;

a friction element of the carrying device presses the hook to provide resistance against pivoting of the hook about the second axis, the friction element comprising a friction cap that surrounds an outer diameter of the head end.

15. The carrying device of claim 14 wherein a recess of the friction cap includes detents, and the outer diameter of the head end comprises a non-circular shape to engage the detents such that the hook pivots about the second axis between predetermined stop positions.

16. The carrying device of claim 14 wherein the hook is rotatably held within a housing and the friction cap is confined within a cavity of the housing.

17. The carrying device of claim 16 wherein the friction cap is further confined by the mounting element.

18. The carrying device of claim 17 wherein the mounting element is a belt clip.

19. A personal carrying device including a mounting element that provides for attaching the device to a user, a normally depending hook, the hook rotatable about a first axis, the hook further rotatable about a second axis substantially perpendicular to the first axis, wherein:

the carrying device includes a housing pivotally attached to the mounting element to allow swivel motion of the housing about the first axis;

the hook is held by the housing wherein the hook is pivotable upon the housing about the second axis;

the hook includes an enlarged head end, the head end having an underside supported by ribs of a slot of the housing;

a friction element of the carrying device presses the hook to provide resistance against pivoting of the hook about the second axis;

the mounting element confines the head end within a cavity of the housing, the head end held by the mounting element against moving out of the cavity in a direction perpendicular to the second axis.

20. The carrying device of claim 19 wherein the friction element comprises a friction cap that surrounds an outer diameter of the head end, and the friction cap is confined within the cavity of the housing.

* * * * *